US007714229B2

(12) United States Patent
Burris et al.

(10) Patent No.: US 7,714,229 B2
(45) Date of Patent: May 11, 2010

(54) COAXIAL CONNECTOR AND COAXIAL CABLE CONNECTOR ASSEMBLY AND RELATED METHOD

(75) Inventors: Donald Andrew Burris, Peoria, AZ (US); William Bernard Lutz, Glendale, AZ (US); Kenneth Steven Wood, Elmira, NY (US)

(73) Assignee: Corning Gilbert Inc., Glendale, AZ (US)

( * ) Notice: Subject to any disclaimer, the term of this patent is extended or adjusted under 35 U.S.C. 154(b) by 196 days.

(21) Appl. No.: 11/729,897

(22) Filed: Mar. 29, 2007

(65) Prior Publication Data

US 2007/0232088 A1 Oct. 4, 2007

Related U.S. Application Data

(60) Provisional application No. 60/787,405, filed on Mar. 29, 2006.

(51) Int. Cl.
*H01R 9/05* (2006.01)

(52) U.S. Cl. ..... 174/75 C

(58) Field of Classification Search ..... 174/74 R, 174/75 C; 439/578

See application file for complete search history.

(56) References Cited

U.S. PATENT DOCUMENTS

| | | | | |
|---|---|---|---|---|
| 3,297,979 | A | 1/1967 | O'Keefe et al. | 339/177 |
| 3,781,762 | A * | 12/1973 | Quackenbush | 439/322 |
| 4,131,332 | A * | 12/1978 | Hogendobler et al. | 439/585 |
| 4,400,050 | A | 8/1983 | Hayward | 339/177 R |
| 4,834,675 | A | 5/1989 | Samchisen | 439/578 |
| 5,002,503 | A | 3/1991 | Campbell et al. | 439/578 |
| 5,254,188 | A * | 10/1993 | Blew | 156/53 |
| 5,259,791 | A | 11/1993 | Buck | 439/578 |
| 5,338,225 | A | 8/1994 | Jacobsen et al. | 439/585 |
| 6,210,222 | B1 | 4/2001 | Langham et al. | 439/583 |
| 6,558,194 | B2 | 5/2003 | Montena | 439/585 |
| 6,790,081 | B2 | 9/2004 | Burris et al. | 439/578 |
| 6,887,102 | B1 | 5/2005 | Burris et al. | 439/578 |
| 6,916,200 | B2 | 7/2005 | Burris et al. | 439/578 |
| 7,371,112 | B2 * | 5/2008 | Burris et al. | 439/578 |
| 2004/0185713 | A1 * | 9/2004 | Holliday | 439/578 |
| 2005/0159044 | A1 | 7/2005 | Harwath et al. | 439/578 |
| 2007/0243759 | A1 * | 10/2007 | Rodrigues et al. | 439/578 |

* cited by examiner

*Primary Examiner*—Chau N Nguyen
(74) *Attorney, Agent, or Firm*—Joseph M. Homa; Matthew J. Mason

(57) ABSTRACT

A method of making a coaxial cable assembly is disclosed, the assembly comprising a coaxial cable and a connector, or connector termination, at least one end of the cable. A connector, comprised of connector components, is also disclosed. The method comprises placing connector components into contact with the cable before the connector components are assembled into a connector. The connector is assembled simultaneously with securing the connector to the cable to make a coaxial cable assembly. A method of preparing coaxial cable in a manner suitable for making coaxial cable assemblies is also disclosed. The coaxial cable assembly can be a jumper, or a lead.

8 Claims, 7 Drawing Sheets

COAXIAL CONNECTOR AND COAXIAL CABLE CONNECTOR ASSEMBLY AND RELATED METHOD

This application claims the benefit of, and priority to U.S. Provisional Application No. 60/787,405, filed on Mar. 29, 2006, entitled "COAXIAL CONNECTOR AND COAXIAL CABLE CONNECTOR ASSEMBLY AND RELATED METHOD", the content of which is relied upon and incorporated herein by reference in its entirety.

BACKGROUND OF THE INVENTION

1. Field of the Invention

The present invention relates generally to coaxial cable connectors and coaxial cable/connector assemblies, and particularly to coaxial cable connectors suitable for coaxial assemblies.

2. Technical Background

Coaxial cable connectors such as RCA, BNC and F-connectors are used to attach coaxial cable to another object such as an appliance or junction having a terminal adapted to engage the connector. F-connectors are often used in conjunction with a length of coaxial cable to create a jumper cable assembly to interconnect components of a cable television system. A jumper typically has one coaxial connector (connector termination) at each end of the length of cable. The coaxial cable typically includes a center conductor, or inner conductor, surrounded by a plurality of outer cable components, for example the inner conductor is surrounded by a dielectric, in turn surrounded by one or more outer conductive layers, or metallic layers, such as a conductive grounding foil and/or braid, wherein the outer conductive arrangement is itself surrounded by a protective outer jacket. The dielectric can be plastic, rubber, glass, or ceramic. Various types of coaxial cable have different outer protective layers or jackets. The F-connector is typically secured over the prepared end of the jacketed coaxial cable by use of a crimp tool or compression tool specifically designed to crimp or actuate the connector. Once secured to the coaxial cable, the connector is then capable of transferring signals by engaging the connector with a threaded connection or threaded port, such as found on typical CATV electronic devices like set top converters, television sets or DVD players.

Crimp style F-connectors are known wherein a crimp sleeve is included as part of the connector body. A crimping tool must be used to deform the crimp sleeve onto the cable to secure the connector to a cable. For example, a special radial crimping tool, having jaws that form a hexagon, can be used to radially crimp the crimp sleeve around the outer jacket of the coaxial cable to secure such a crimp style F-connector over the prepared end of the coaxial cable, such as described in U.S. Pat. No. 4,400,050 to Hayward. However, crimping braided outer conductors can present some difficulties. To prevent deformation of the outer cable components in relation to the center conductor, a support sleeve of one form or another may be used. Usually, the braid is captured in a layer between a tubular outer ferrule and the connector body, wherein the outer ferrule is crimped onto the crimp sleeve which in turn is radially compressed into engagement with the cable, but such crimps are not typically considered to be highly reliable, because, for example, there are typically large voids in the interface allowing for corrosive degradation of the contact surfaces, and/or the mechanical pull strength to the joint does not approach the strength of the wire. Additionally, such a crimp connection typically allows relative movement between all three components, which results in a very poor, noisy electrical connection.

Another known form of F-connector includes an annular compression sleeve used to secure the F-connector over the prepared end of the cable. Rather than crimping a crimp sleeve radially toward the jacket of the coaxial cable, these F-connectors employ an annular compression sleeve, typically plastic, that is initially attached to the F-connector, but which is detached therefrom prior to installation of the F-connector. The compression sleeve includes an inner bore for allowing such compression sleeve to be passed over the end of the coaxial cable prior to installation of the F-connector. The remainder of the F-connector itself is then inserted over the prepared end of the coaxial cable. Next, the compression sleeve is compressed axially along the longitudinal axis of the connector into the body of the connector, which simultaneously causes the jacket of the coaxial cable to be compressed between the compression sleeve and the tubular post of the connector as the compression sleeve moves radially inward. An example of such a compression sleeve F-connector is described in U.S. Pat. No. 4,834,675 to Samchisen. A number of commercial tool manufacturers provide compression tools for axially compressing the compression sleeve into such connectors.

Standardized cable preparation tooling and connector actuation tooling have lead to a de facto standard in cable preparation dimensions and connector envelope configurations. Additional requirements for both in-door and out-door use have resulted in connector designs that require a relatively large number of components. While standardized cable preparation tooling and connector actuation tooling has increased flexibility and interchangeability in field installations where an installer is concerned with making cable connection using one or a few connectors at a particular location, the implementation of these standardized connector and tooling systems for the manufacture of cable assemblies such as CATV jumper cables in large quantities tends to limit the efficiency of mass assembly of the jumpers, thereby causing unnecessary expense to be incurred in the manufacture of the assemblies.

FIGS. 1A-1C are partial cutaway views along the centerline of a coaxial cable illustrating typical known in-field cable preparation. FIG. 1A shows cable 100 comprising center conductor 101, dielectric 102 surrounding and in contact with the center conductor 101, outer conductor or shield 103 surrounding and in contact with dielectric 102, braid 104 surrounding and in contact with shield 103, and jacket 105 surrounding and in contact with braid 104. Basic preparation techniques are noted in steps 1 through 3. FIG. 1A shows cable 100 cut out to a desired length. FIG. 1B shows the result of removing outer cable components to expose center conductor 101 and braid 103. The standard exposed length of braid 106 is ¼", and the standard exposed length of center conductor 107 is 5/16". A multitude of industry standard tools are available to perform the necessary cuts to achieve the "standard" dimensions illustrated in FIG. 1B. FIG. 1C shows the result of un-weaving of braid 104 and folding back of braid 104 along jacket 105, which is typically performed manually and requires dexterity and time to accomplish properly.

FIG. 2 is a side cutaway view along the centerline of a known connector/cable combination. Connector 200 shown in FIG. 2 illustrates a relatively high number (six) of component parts required to meet the combined indoor and outdoor functional requirements placed on many F connectors. Additionally, FIG. 2 illustrates a difference in outer diameter between the outermost diameters of coupling nut 201 and body 204, which provides a relatively small exposed region E1 of the proximal side of coupling nut 201 in which to grasp the coupler 201 during installation. A limited difference in outer diameter E1 (and the resulting limited area of exposure) can be somewhat mitigated by increasing clearance space 207 defined by the rear end 208 of the coupler 201 and the outer surface of body 204, wherein space 207 can allow installer fingers a greater purchase area, but may not provide an entirely satisfactory solution, particularly if coupling nut 201 is plated with a relatively low coefficient of friction, or slippery, material, such as nickel. Clearance space 207 can be somewhat useful for pushing coupling nut 201 forward during installation, but more access to the back of coupling nut 201 but would be more advantageous. However, couplers are typically provided in standard sizes, and, for given standard coupler sizes, practical limits exist on reducing the outer diameter of the body of known connectors (for example because such connectors need to be able to receive the folded back braid of the cable and need to be able to clamp onto the cable, the outside diameter of the body needs to be large enough to structurally accommodate those features), so limitations exist on the flexibility of increasing the difference in outer diameter E1 in known connectors, used in conjunction with known cable preparation methods.

SUMMARY OF THE INVENTION

Disclosed herein is a method of making a coaxial cable assembly, the assembly comprising a coaxial cable and a connector, or connector termination, at least one end of the cable. A connector, comprised of connector components, is also disclosed herein. The method comprises placing connector components into contact with the cable before the connector components are assembled into a connector. The connector is assembled simultaneously with securing the connector to the cable to make a coaxial cable assembly. Also disclosed herein is a method of preparing coaxial cable in a manner suitable for making coaxial cable assemblies. The coaxial cable assembly can be a jumper, or a lead.

The connector disclosed herein is comprised of a small number of components that can be installable on a coaxial connector cable in an extremely efficient manner in terms of time, labor, and material costs. Additionally, such a connector is easy to use as a cable termination, such as when applied as in a connector/cable assembly such as a jumper assembly, while providing provide necessary signal shielding and sufficient retention on the coaxial cable. Implementation of the method disclosed herein for cable preparation permits the connector disclosed herein to have a shortened length. The method of installing the connector onto coaxial cable permits flexibility and interchangeability during assembly, where, for example, various types and/or sizes of couplers can be matched with various shells and/or posts, which would not otherwise be available with connectors that require pre-assembly before attachment to a cable.

In one aspect, a method of making a coaxial cable assembly is disclosed herein, the method comprising: passing an end of a coaxial cable through an internal bore in a tubular shell, wherein the coaxial cable has a longitudinal axis; inserting a first portion of a tubular post axially into the end of the coaxial cable, wherein the shell is axially spaced away from the first portion of the post, and the shell does not surround the first portion of the post; and moving the shell axially relative to the post and the cable, wherein at least part of the shell surrounds at least part of the post. Preferably, a coupler is mounted on the post, fixedly or rotatably. In some embodiments, the shell limits axial movement of the coupler. In some embodiments, in the moving step, the shell and the post are press fit together. In some embodiments, after the moving step, part of the cable is sandwiched between the shell and the post.

In another aspect, a method of making a coaxial cable assembly is disclosed herein, the method comprising: passing an end of a coaxial cable through an internal bore in a tubular shell; inserting a tubular post into the end of the coaxial cable, wherein the shell is spaced away from the post, and the shell does not surround the post; and moving the shell and the post together sufficient to surround at least part of the post with at least part of the shell.

In some embodiments, before the inserting step, the shell is capable of sliding over the cable disposed within the internal bore of the shell. In some embodiments, the moving step further comprises bringing the shell into direct mechanical contact with the post. In some embodiments, the inserting step further comprises raising a raised portion of the cable radially outwardly; preferably, in the moving step, at least part of the raised portion of the cable is disposed between the at least part of the post and the at least part of the shell. In some embodiments, after the moving step, the shell limits movement of the coupler.

In some embodiments, the method further comprises, before the inserting step, mounting a coupler on the post. In some embodiments, the coupler is rotatably mounted on the post. In some embodiments, the coupler is fixedly mounted on the post.

In another aspect, a method of making a coaxial cable assembly is disclosed herein, the method comprising: providing a length of coaxial cable having an end, the cable comprising an inner conductor and outer components surrounding the inner conductor, the outer components comprising a first outer component surrounded by a second outer component; providing a tubular shell, a tubular post, and a coupler mounted on a front end of the post; inserting the end of the cable into a first end of the tubular shell; inserting a back end of the tubular post into the end of the cable, wherein the back end is wedged between the first outer component and the second outer component of the cable; and moving the tubular shell axially toward the front end of the post sufficient for the shell to surround at least a portion of the tubular post, thereby causing the shell and the post to transmit a compressive force to the second outer component sufficient to secure the shell and the post onto the cable.

In another aspect, a combination of coaxial cable connector components is disclosed herein, the combination comprising: a tubular shell having a shell inner diameter defining a internal bore adapted to accept a coaxial cable, and a shell outer diameter; a tubular post adapted to be inserted into the coaxial cable; and a coupler adapted to mount on the post and having a coupler outer diameter, wherein the ratio of the coupler outer diameter divided by the shell outer diameter is greater than 1.10. In some embodiments, the ratio of the coupler outer diameter divided by the shell outer diameter is greater than 1.20. In some embodiments, the ratio of the coupler outer diameter divided by the shell outer diameter is greater than 1.25. In some embodiments, the ratio of the coupler outer diameter divided by the shell outer diameter is greater than 1.30.

In another aspect, a combination is disclosed herein of a coaxial cable and a coaxial cable connector mounted on the cable, the connector consisting of a tubular post inserted into the cable, a tubular shell surrounding part of the cable and surrounding at least part of the tubular post, and a coupler mounted on the tubular post, wherein the shell is disposed on the cable and is axially spaced apart from the post in an uncompressed state, and wherein the shell at least partially surrounds the post in a compressed state. In some embodiments, part of the cable is sandwiched between the tubular post and the shell, and the shell and the post cooperatively impart a compressive force to the part of the cable, thereby securing the cable, the post, and the shell in a cable termination.

In another aspect, a method of preparing an end of a coaxial cable is disclosed herein, the coaxial cable comprising an inner conductor, a dielectric surrounding the inner conductor, a braid surrounding the dielectric, and a protective layer surrounding the braid, the method comprising: removing a portion of the protective layer, a portion of the braid, and a portion of the dielectric from the end of the coaxial cable to provide a prepared end of the cable, wherein the prepared end comprises: a protective layer cut edge; a protruding portion of the braid that protrudes a length X from the cut edge of the protective layer, a protruding portion of the dielectric that protrudes a length Y from the cut edge of the protective layer, and a protruding portion of the inner conductor that protrudes a length Z from the cut edge of the protective layer, wherein the ratio of X/Y is less than 1. In some embodiments, the ratio of X/Y is less than 0.5. In some embodiments, the ratio of X/Y is less than 0.25.

In some embodiments, the protruding portion of the dielectric terminates in a dielectric cut edge, and the protruding portion of the inner conductor protrudes a length A from the dielectric cut edge. In some embodiments, length A is between 0.25 and 0.375 inch. In other embodiments, length A is about 0.25 inch.

In some embodiments, the coaxial cable further comprises a foil layer surrounding the dielectric. The foil layer can be disposed between the dielectric and the braid, or the foil layer can be disposed between the braid and the protective layer.

In some embodiments, the coaxial cable further comprises a foil layer disposed between the braid and the dielectric, wherein the removing step further comprises removing a portion of the foil layer, and wherein the prepared end further comprises a protruding portion of the foil layer that protrudes a length Y' from the cut edge of the protective layer, wherein the length Y' is less than or equal to the length Y, i.e. the protruding portion of the foil can extend y' all the way up to the cut edge of the dielectric, and greater than the length X. In some embodiments, Y' is about 5/16 inch.

In some embodiments, the method further comprises lifting at least part of the protruding portion of the braid radially outwardly, and in some embodiments, flaring at least part of the protruding portion of the braid radially outwardly.

In one embodiment, X is 1/16 inch, Y is 5/16 inch, Z is 9/16 inch, and A is 1/4 inch.

In this aspect, a method of making a coaxial cable assembly with the cable thus is disclosed herein, the method comprising: before the removing step, providing a tubular shell having an internal bore and passing the cable through the internal bore. The shell is adapted to receive the cable through the internal bore, allowing the tubular shell to slide along the cable. The method of making a coaxial cable assembly may further comprise: providing a tubular post; inserting an end of the tubular post into the prepared end of the cable and under the braid; and moving the prepared end of the cable and the tubular post axially together with the tubular shell sufficient for the post and the shell to cooperatively apply a radial force to the braid thereby securing the shell and the post onto the cable.

In some embodiments, in the moving step, the protective layer and the braid are sandwiched between the tubular shell and the tubular post.

In some embodiments, after the moving step, the protruding portion of the braid is disposed in an annular cavity between the post and the shell.

In some embodiments, in the moving step, the shell directly physically contacts the post. In some embodiments, in the moving step, the post and the shell are press fit together.

In some embodiments, the end of the post comprises a radially raised portion, and the moving step further comprises moving the prepared end of the cable and the tubular post axially together with the tubular shell such that at least part of the shell surrounds the radially raised portion of the post.

In this aspect, the method can further comprise lifting at least part of the protruding portion of the braid radially outwardly, either before inserting the tubular post into the prepared end of the cable, or simultaneously with inserting the tubular post into the prepared end of the cable.

In some embodiments, the step of inserting the tubular post further comprises trapping the at least part of the protruding portion of the braid between the protective layer cut end and the tubular post.

In some embodiments, the providing step further comprises providing a coupler mounted on the tubular post.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1A:
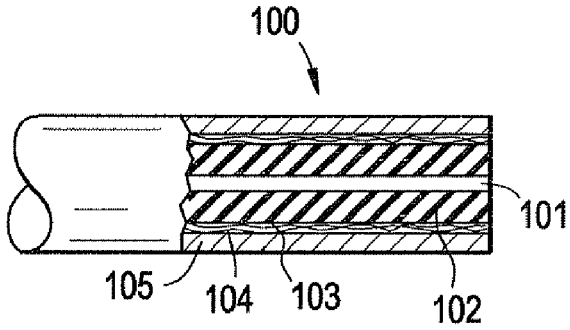
FIG. 1A PRIOR ART
FIG. 1A shows a partial cutaway view of an end of a known coaxial cable.
Figure 1B:
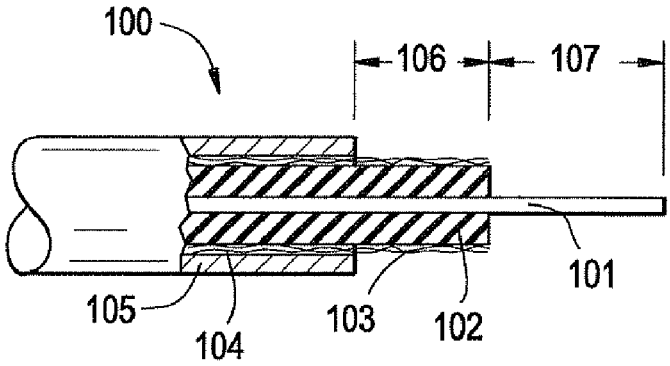
FIG. 1B PRIOR ART
FIG. 1B shows the cable of FIG. 1A with outer cable components removed to expose braid and the center conductor.
Figure 1C:
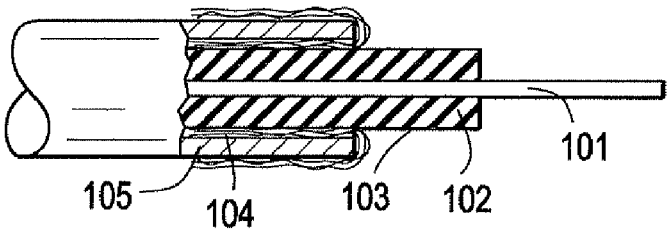
FIG. 1C PRIOR ART
FIG. 1C shows the cable of FIG. 1B with the braid folded back over the jacket.
Figure 2:
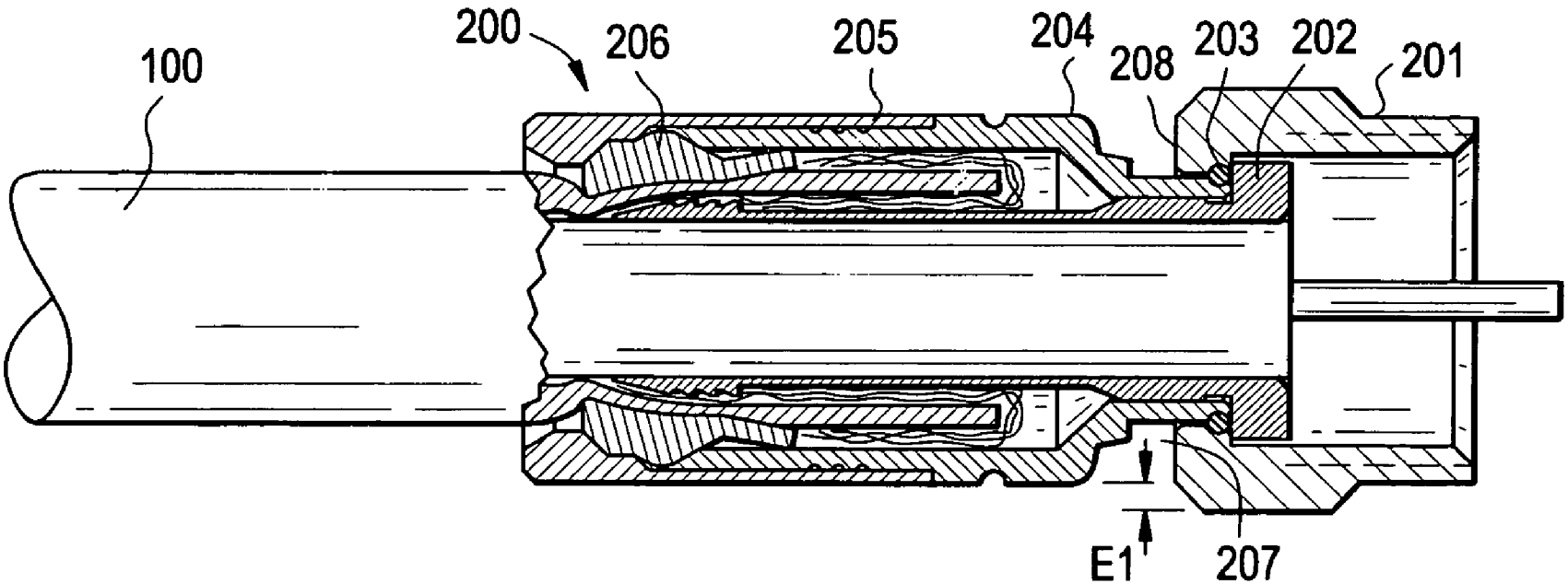
FIG. 2 PRIOR ART
FIG. 2 is a side cutaway view along the centerline of a known connector connected to a cable, shown in partial cutaway view, prepared according to a known method.

Reference will now be made in detail to the present preferred embodiment(s) of the invention, examples of which are illustrated in the accompanying drawings. Whenever possible, the same reference numerals will be used throughout the drawings to refer to the same or like parts.

Figure 3A:
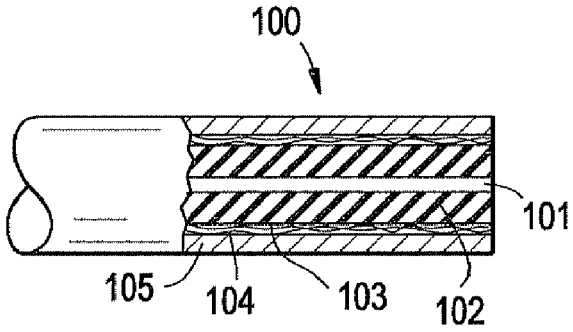
FIGS. 3A-3C are partial cutaway views along the centerline of a coaxial cable illustrating the cable preparation method for the current invention.
Figure 3B:
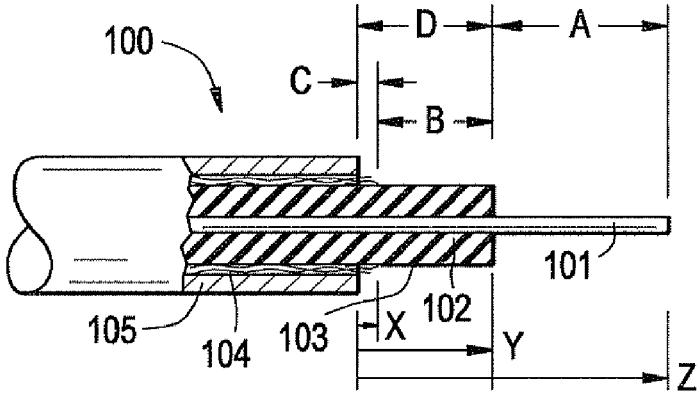
Figure 3C:
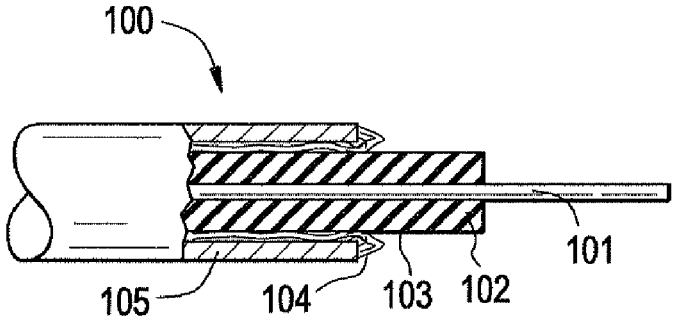

FIGS. 3A-3C are partial cutaway views along the centerline of a coaxial cable illustrating the cable preparation method as disclosed herein. FIG. 3A shows cable 100 comprising center conductor 101, dielectric 102, outer conductor or shield 103, braid 104, and jacket 105. For some embodiments, such as a coaxial cable jumper, a desired length of cable 100 is cut, preferably making a clean cut. Referring to FIG. 3B with a desired length of cable 100, the cable preparation includes removing a portion of the protective layer 105, a portion of the braid 104, and a portion of the dielectric 102 from the end of the coaxial cable to provide a prepared end of the cable, which can be effected using one or more known tools, wherein the prepared end comprises: a protective layer cut edge 110; a protruding portion of the braid 104 that protrudes a length X from the cut edge of the protective layer 105, a protruding portion of the dielectric 102 that protrudes a length Y from the cut edge of the protective layer 105, and a protruding portion of the inner conductor 101 that protrudes a length Z from the cut edge of the protective layer 105, wherein the ratio of X/Y is less than 1, preferably less than 0.5, more preferably less than 0.25. Thus, the cable preparation includes removing outer components of the cable 100, such as dielectric 102, outer conductor or shield 103, braid 104, and/or jacket 105, as appropriate, to expose a length A of the center conductor 101, and to expose a length B of the shield 103, and to expose a length C of the braid 103, wherein the shield 103 and dielectric protrude beyond the end of the cable jacket 105 for a length D, where D=B+C, and the tip of the center conductor is disposed a length E away from the end of the cable jacket 105, where E=A+B+C=A+D, wherein the ratio of C/B is less than 1, preferably less than 0.5, more preferably less than 0.25. In some embodiments, the method further comprises the step of lifting at least a portion of the exposed length C of braid 104 radially outwardly, e.g. away from shield 103, preferably toward the end of jacket 105. In some embodiments, the lifting comprises flaring at least a portion of the exposed length C of braid 104 away from shield 103, for example by applying a tool having a conically tapered portion to the cable 100 and under exposed length C, or by applying part of the connector to the cable during connection of the connector onto the cable.

Even if desired dimensions for cable preparation disclosed herein are not readily achievable by use of industry standard available tooling intended for use in the field by a single installer, such desired dimension can be easily achieved by high speed factory production tooling.

Figure 4:
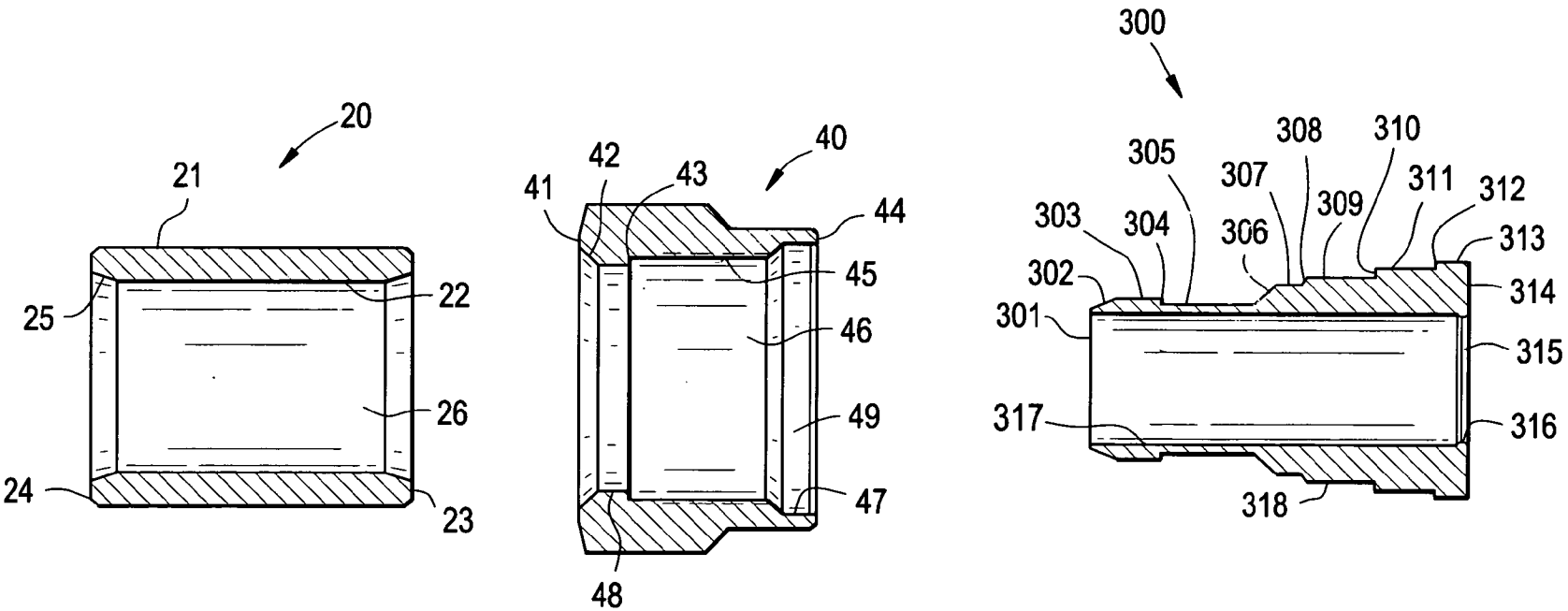
FIG. 4 is a side cutaway view along the center line of the present invention components.

Referring to FIG. 4, the connector components of connector 20 comprises a tubular shell 20, a coupler 40, and a tubular post 300. In some preferred embodiments, the connector consists of the tubular shell 20, a coupler 40, and a tubular post 300. Shell 20 is preferably made from metal and plated with a non-corrosive material such as nickel. Alternatively, shell 20 can be constructed from an engineering polymer, such as polyamides (e.g. nylon), polyesters, polyimides, and/or polysulfones. Preferably, coupler 40 is made from a conductive material such as brass and is plated with a corrosion resistant material, for example nickel. Alternatively, coupler 40 may be constructed from an engineering polymer. Tubular post 300 is preferably made from electrically conductive material, such as brass and is preferably plated with a conductive material such as tin.

In some embodiments, the braid 104 is flared by a tool, or by angled surface 302 of post 300 which is driven under the braid 104 thereby further reducing cable preparation time and effort. Thus, folding back of braid 104 over the outside of the jacket 105 as found in known cable preparation methods is eliminated, thereby reducing the amount of skill and time to prepare the cable.

As seen in FIG. 4, shell 20 is generally tubular and comprises outer diameter 21, front end 23, back end 24, internal surface 22 defining internal bore 26 which extends between front and back ends, 23 and 24. By generally tubular, we mean that either the outer surface or the internal surface 22, or both, of shell 20 can have more than one diameter or shape. Internal surface 22 preferably has an internal chamfer 25 located proximate to front or back ends 23 and 24, more preferably an internal chamfer 25 at both the front end 23 and the back end 24. In some embodiments, both the front end 23 and back end 24 are each provided with chamfers 25 and shell 20 thereby making shell 20 bi-directional in regard to installation orientation, whereby cost can be further reduced by simplifying the installation process. In some embodiments, both the front end 23 and back end 24 are each provided with chamfers 25 and shell 20 is substantially symmetric about a plane perpendicular to the longitudinal axis.

Coupler 40 comprises back end 41, front end 44, and internal surface 49 defining internal bore 46. The coupler 40 shown in FIG. 4 is in the form of a coupling nut, wherein internal surface 49 comprises internal chamfer 42, inwardly projecting annular ridge 43, internal threads 45, and internal recess 47. The reduced diameter of annular ridge 43 defines a reduced diameter through-bore section 48 of internal bore 46. The increased diameter of internal recess 47 defines an increased diameter through-bore section 49 of internal bore 46. Coupler 40 may also take other forms in other embodiments. Tubular post 300 is generally tubular and comprises back end 301, front end 314, outer surface 318, and internal surface 317 defining through-bore 315. By generally tubular, we mean that either internal surface 317 or outer surface 218, or both, can have more than one diameter or shape. Back end 301 of tubular post 300 is adapted to be inserted into the end of the cable 100 and enter between braid 104 and shield 103. Front end 314 is adapted to engage coupler 40. In some embodiments, post 300 rotatably engages coupler 40. The outer surface 318 of post 300 shown in FIG. 4 comprises external tapered area 302 at back end 301, outer diameter 303, external annular face 304, reduced diameter 305, tapered portion 306, outer diameter 307, tapered portion 308, outer diameter 309, backward facing annular face 310, outer diameter 311, backward facing annular face 312, and outer diameter 313. The internal surface 317 of post 300 shown in FIG. 4 comprises an inwardly projecting lip 316 which defines a reduced diameter through-bore portion 315 of internal bore 315. The angled surface of external tapered area 302 can be used to engage exposed length C of braid 104 as the cable as post 300 and cable 100 are driven together during assembly in order to lift at least a portion of exposed length C radially outward. Tubular post 300 may also take other forms in other embodiments.

Figure 5:
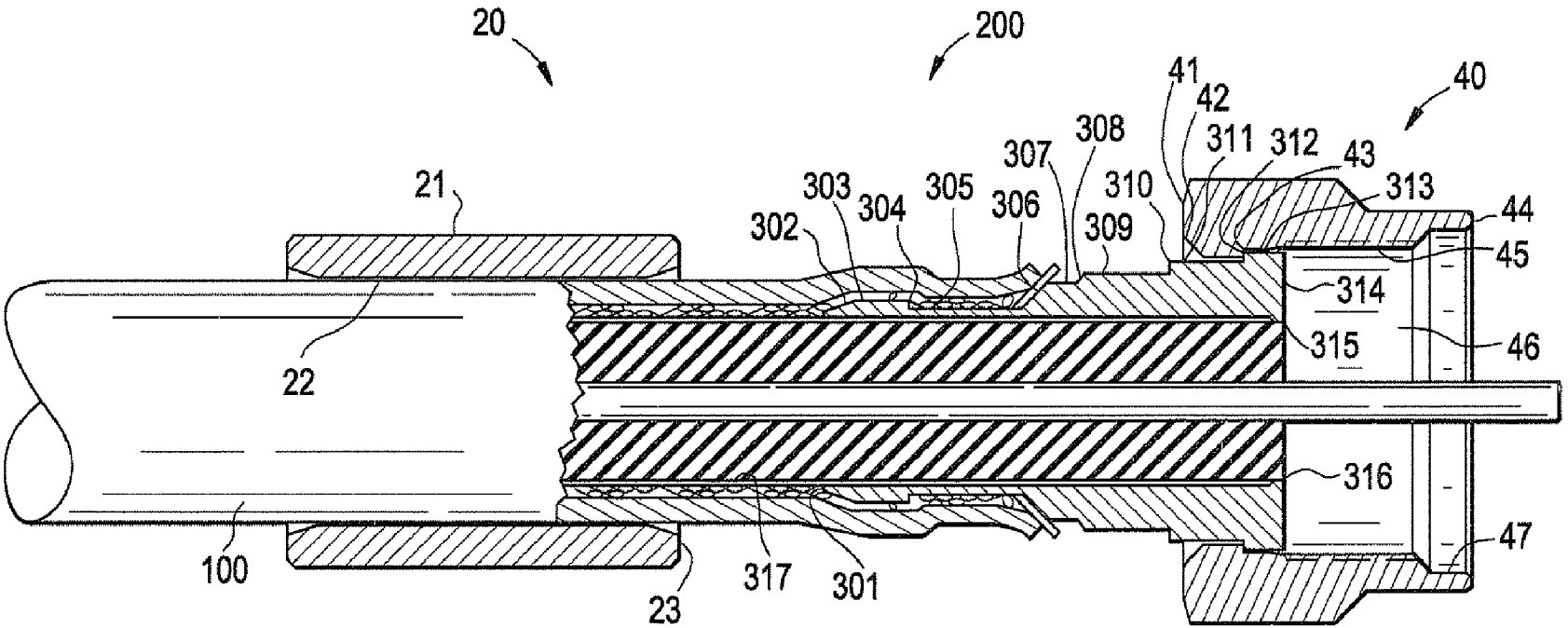
FIG. 5 is a side cutaway view along the centerline of the connector disclosed herein and a partial side cutaway view along the centerline of a cable prepared according to a method disclosed herein.

FIG. 5 shows a side cutaway view of connector 200 partially installed on coaxial cable, shown in partial side cutaway view along the centerline of the cable. Shell 20 is installed over prepared cable 100. Coupler 40 is installed over tubular post 300. After shell 20 is installed on cable 100 and coupler 40 is installed on post 300, back end 301 of post 300 is then inserted into cable 100 between shield and braid. In the embodiment shown in FIG. 5, coupler 40 is capable of rotating around post 300, that is, the diametral relationship of outer diameter 311 and through-bore 48 allows coupler 40 to rotate about tubular post 300 when coupler 40 is disposed about tubular post 300. Forward movement of coupler 40 relative to post 300 is restrained by engagement of annular ridge 43 and backward facing annular face 312, thereby preventing coupler 40 from falling off from the front end 314 of post 300.

In use, the end of coaxial cable 100 is brought together with tubular post 300, i.e. the back end 301 of tubular post 300, such that the cable outer conductor 103, dielectric 102 and center conductor 101 enter bore 317 of tubular post 300 such that cable 100 is impaled upon back end 301 of tubular post 300. In the embodiment shown in FIG. 5, the back end 301, tapered portion 302, outer diameter 303 and reduced diameter 305 of tubular post 300 are driven between braided shield 104 and the outer conductor 103 of cable 100, preferably until the dielectric 102 at the end of the cable 100 is flush with the front end 314 of tubular post 300. Cable trim length as illustrated indicated in FIG. 3B is such that flared portion of cable braid 104 is forced into contact with, and may be shaped by, tapered portion 306 of tubular post 300. In this embodiment, a small protuberance of braid 104 extends radially outwardly and axially beyond tapered portion 306.

Figure 6:
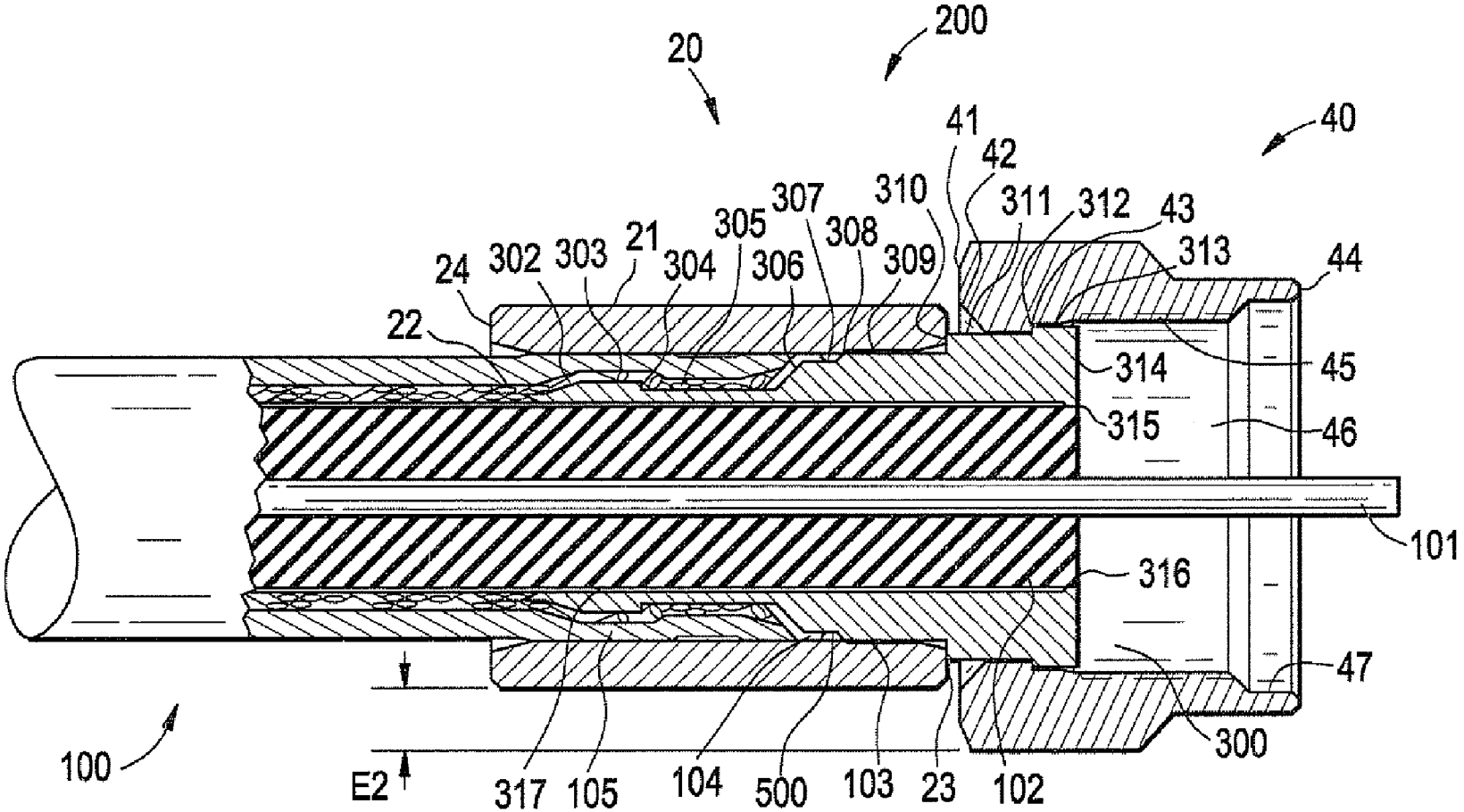
FIG. 6 is a partial side cutaway view along the centerline of the present invention with an F connector interface fully installed on coaxial cable.

Referring to FIG. 6 which shows the connection between connector 200 and the cable 100 in the completed, i.e. fully installed or fully compressed, state, wherein shell 20 is advanced axially forward to surround at least a part of tubular post 300 and cable 100. No further crimping or manipulation is required after shell 20 is fully advanced. Upon advancement of shell 20, jacket 105 and braid 104 are preferably sandwiched between shell 20 and post 300, shown in FIG. 6 where internal surface 22 and outer diameter 303 of outer surface 318 of tubular post 300 sandwich jacket 105 and braid 104. In some embodiments, a portion of braid 104 is disposed in an annular cavity formed between the inner surface of shell 20 and the outer surface of post 300, and preferably seized therebetween, for example as seen in the annular cavity 500 shown in the embodiment of FIG. 6. Trapping and seizing of braid 104 within such annular cavity as cavity 500 can provide additional and improved electrical grounding and improved mechanical retention of braid 104 thereby improving electrical and mechanical communication between cable 100 and connector 200. When the connector in in embodiments such as shown in FIG. 6 is fully installed on cable 100, rearward axial movement of coupler 40 is limited by front end 23 of shell 20. Lip 316 can serve to both position (for example, center) and restrain further axial movement of cable dielectric 102 with respect to the post 300.

After the shell 20, post 300 and coupler 40 are installed on cable 100, the resulting connector/cable combination, or assembly, can then be placed into contact with a terminal, such as a threaded terminal. Using the advantage found in increased exposure area E2 the coupler 40 may be tightened onto the threaded terminal for electrical and mechanical coupling of the coaxial cable 100.

Figure 7:
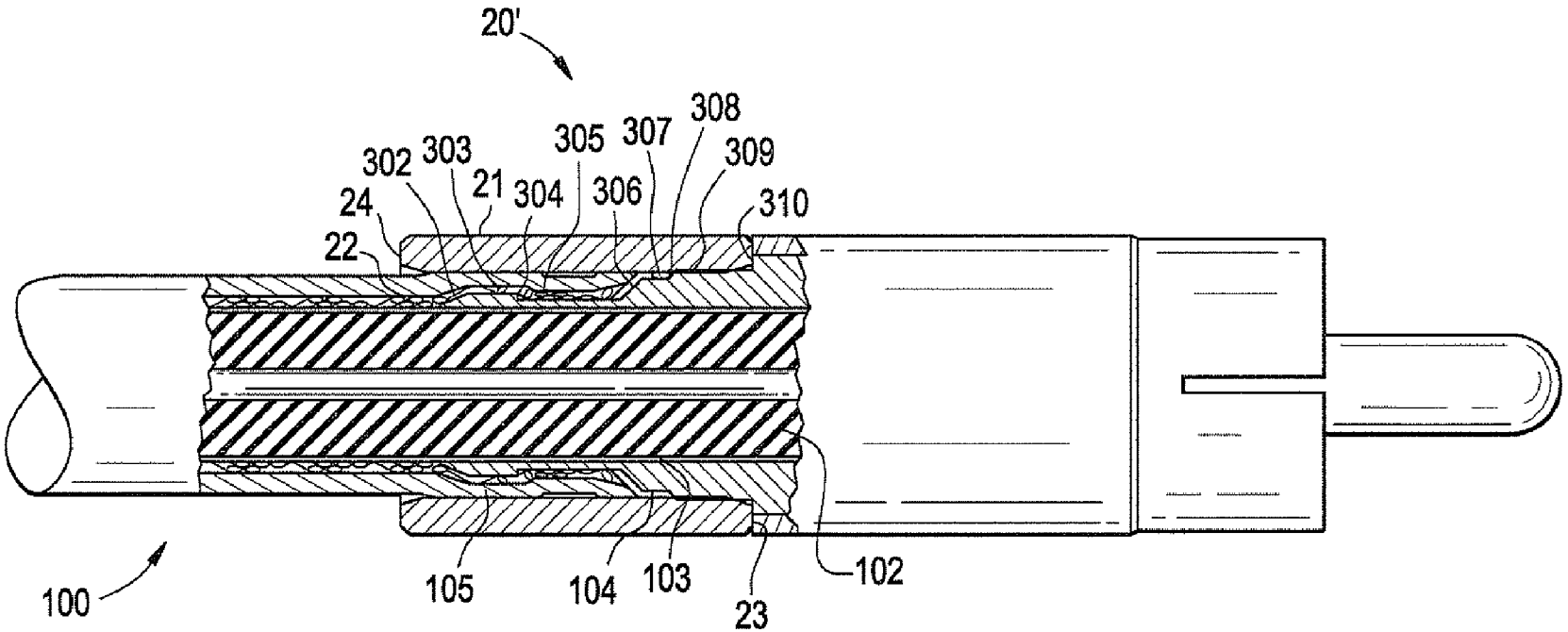
FIG. 7 is a partial side cutaway view along the centerline of the present invention with an RCA connector interface fully installed on coaxial cable.

FIG. 7 illustrates another embodiment of a connector 20' disclosed herein fully installed on a cable 100 prepared according to the method disclosed herein. Both cable 100 and connector 20' are shown in partial side cutaway view along the centerline of the cable and the connector. Coupler 40 of connector 20' comprises an RCA connector interface fixedly mounted to the post. In the embodiment shown in FIG. 7, the back end of coupler 40 abuts and physically directly contacts shell 200 in the fully installed state.

Thus, connectors as disclosed herein may take the form of type F connectors, RCA connectors, BNC connectors, and other types or varieties of connectors by providing an appropriate coupler and engagement between the coupler and the post.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A method of making a coaxial cable assembly, the coaxial cable comprising an inner conductor, a dielectric surrounding the inner conductor, a braid surrounding the dielectric, and a protective layer surrounding the braid, the method comprising:

passing an end of a coaxial cable through an internal bore in a tubular shell, wherein the coaxial cable has a longitudinal axis;

inserting a first portion of a tubular post axially into the end of the coaxial cable, wherein a coupler is mounted on the post, and wherein the shell is axially spaced away from the first portion of the post, and the shell does not surround the first portion of the post;

moving the shell axially relative to the post and the cable, wherein at least part of the shell surrounds and contacts at least part of the post;

wherein, after the moving step, at least a portion of the braid is seized between the post and the shell and the shell limits axial movement of the coupler;

and wherein the method further comprises:

removing a portion of the protective layer, a portion of the braid, and a portion of the dielectric from the end of the coaxial cable to provide a prepared end of the cable, wherein the prepared end comprises: a protective layer cut edge; a protruding portion of the braid that protrudes a length X from the cut edge of the protective layer, a protruding portion of the dielectric that protrudes a length Y from the cut edge of the protective layer, and a protruding portion of the inner conductor that protrudes a length Z from the cut edge of the protective layer, wherein the ratio of X/Y is less than 1.

2. The method of claim 1 wherein the coupler is rotatably mounted on the post.

3. The method of claim 1 wherein, in the moving step, the shell and the post are press fit together.

4. The method of claim 1, wherein after the moving step, part of the cable is sandwiched between the shell and the post.

5. The method of claim 1 wherein the protruding portion of the dielectric terminates in a dielectric cut edge, and the protruding portion of the inner conductor protrudes a length A from the dielectric cut edge.

6. The method of claim 5 wherein the length A is between 0.25 and 0.375 inch.

7. The method of claim 1 wherein the coaxial cable further comprises a foil layer disposed between the braid and the dielectric, wherein the removing step further comprises removing a portion of the foil layer, and wherein the prepared end further comprises a protruding portion of the foil layer that protrudes a length Y' from the cut edge of the protective layer, wherein the length Y' is less than or equal to the length Y.

8. The method of claim 1 further comprising lifting at least part of the protruding portion of the braid radially outwardly.

* * * * *